US008615966B2

(12) United States Patent
Thompson

(10) Patent No.: US 8,615,966 B2
(45) Date of Patent: Dec. 31, 2013

(54) INFLATABLE STRUCTURE

(75) Inventor: Mark Thompson, Warrington (GB)

(73) Assignee: Finecard International Limited, Widnes, Cheshire (GB)

( * ) Notice: Subject to any disclaimer, the term of this patent is extended or adjusted under 35 U.S.C. 154(b) by 0 days.

(21) Appl. No.: 13/266,915

(22) PCT Filed: Jun. 9, 2010

(86) PCT No.: PCT/GB2010/050970

§ 371 (c)(1), (2), (4) Date: Oct. 28, 2011

(87) PCT Pub. No.: WO2010/142991

PCT Pub. Date: Dec. 16, 2010

(65) Prior Publication Data

US 2012/0090248 A1 Apr. 19, 2012

(30) Foreign Application Priority Data

Jun. 10, 2009 (GB) ..... 0909969.8

(51) Int. Cl.
*E04B 1/00* (2006.01)

(52) U.S. Cl.
USPC ..... 52/745.19; 52/2.18; 52/2.13; 446/221

(58) Field of Classification Search
USPC ..... 52/2.18, 745.19, 108, 2.11, 2.13; 446/220, 221
See application file for complete search history.

(56) References Cited

U.S. PATENT DOCUMENTS 2,066,960 A * 1/1937 Cook et al. ..... 254/134.3 R
2,297,150 A * 9/1942 Hunter ..... 52/2.21
2,946,337 A * 7/1960 Wolshin ..... 52/2.21
2,955,606 A * 10/1960 Walker ..... 52/2.21
3,172,166 A * 3/1965 Imbrecht ..... 52/2.11
3,258,883 A * 7/1966 Campanaro et al. ..... 52/2.16
3,364,632 A * 1/1968 Isaac ..... 52/2.22
3,480,023 A * 11/1969 McConnell et al. ..... 135/125
3,599,677 A * 8/1971 O'Brien ..... 138/122
3,899,853 A * 8/1975 Wertman ..... 52/2.18
4,068,418 A * 1/1978 Masse ..... 52/2.21
4,251,959 A * 2/1981 Hsu ..... 52/2.21
4,295,302 A * 10/1981 Liu ..... 52/2.21
4,317,315 A * 3/1982 LeBlang ..... 52/2.21
4,332,112 A * 6/1982 Hsu ..... 52/2.21

(Continued)

*Primary Examiner* — Joshua J Michener
*Assistant Examiner* — James Ference

(57) ABSTRACT

A structure which is transformable by inflation from a collapsed condition for storage to an erect condition for use has an inflatable tubular framework and at least one flexible web attached to and extending between two or more regions of the framework. The inflatable framework is formed by at least one inner inflatable tubular element (A, B) of flexible, elastic, air-impermeable material and having an inflation valve (13, 15) accommodated within an outer sleeve arrangement of a material which is flexible but substantially non-elastic and restrained therein upon inflation. The outer sleeve arrangement is configured to include at least one branch point and/or at least one abrupt bend and the configuration of the inner tubular element or elements (A, B) corresponds to that (branch points (a, b) and abrupt bends (z)) so that the inner tube or tubes will substantially fill the outer sleeve arrangement upon inflation. Each inner tube (A, B) is formed by cutting and bonding of the air-impermeable material to provide a continuous inflatable compartment of relevant configuration and is inserted through an opening in the outer sleeve arrangement and fed through so as to fill it when later inflated in use.

5 Claims, 9 Drawing Sheets

(56) References Cited

U.S. PATENT DOCUMENTS

| | | | | | |
|---|---|---|---|---|---|
| 4,384,435 | A | * | 5/1983 | Polise et al. | 52/2.19 |
| 4,607,655 | A | * | 8/1986 | Wagner et al. | 52/2.19 |
| 4,819,389 | A | * | 4/1989 | Kihn | 52/2.21 |
| 4,901,481 | A | * | 2/1990 | Seeley, Jr. | 52/2.15 |
| 5,007,212 | A | * | 4/1991 | Fritts et al. | 52/2.18 |
| 5,140,768 | A | * | 8/1992 | Forbes | 47/17 |
| 5,205,086 | A | * | 4/1993 | Heim | 52/2.13 |
| 5,247,768 | A | * | 9/1993 | Russo | 52/2.13 |
| 5,487,400 | A | * | 1/1996 | Dawkins | 135/87 |
| 5,546,707 | A | * | 8/1996 | Caruso | 52/2.13 |
| 5,570,544 | A | * | 11/1996 | Hale et al. | 52/2.18 |
| 5,669,182 | A | * | 9/1997 | Griffis | 52/2.18 |
| 5,780,123 | A | * | 7/1998 | Kamiyama et al. | 428/35.2 |
| 5,860,251 | A | * | 1/1999 | Gleich | 52/2.25 |
| 5,893,237 | A | * | 4/1999 | Ryon et al. | 52/2.18 |
| 5,893,238 | A | * | 4/1999 | Peacock et al. | 52/2.18 |
| 6,119,408 | A | * | 9/2000 | Page | 52/2.23 |
| 6,192,633 | B1 | * | 2/2001 | Hilbert | 52/2.18 |
| 6,260,306 | B1 | * | 7/2001 | Swetish et al. | 52/2.18 |
| 6,263,617 | B1 | * | 7/2001 | Turcot et al. | 52/2.18 |
| 6,438,900 | B1 | * | 8/2002 | Page | 52/2.23 |
| 6,442,903 | B1 | * | 9/2002 | Hebert | 52/2.11 |
| 6,463,699 | B1 | * | 10/2002 | Bailey et al. | 52/2.11 |
| 6,565,405 | B2 | * | 5/2003 | Hsu et al. | 446/89 |
| 6,708,451 | B1 | * | 3/2004 | Gomes | 52/2.17 |
| 6,722,084 | B2 | * | 4/2004 | Berman | 52/2.11 |
| 7,481,234 | B1 | * | 1/2009 | Gustafson et al. | 135/91 |
| 2004/0261324 | A1 | * | 12/2004 | Tewari | 52/2.18 |
| 2009/0249701 | A1 | * | 10/2009 | Turcot | 52/2.18 |
| 2009/0300993 | A1 | * | 12/2009 | Lamke | 52/2.18 |
| 2012/0090248 | A1 | * | 4/2012 | Thompson | 52/2.18 |

* cited by examiner

INFLATABLE STRUCTURE

TECHNICAL FIELD

This invention concerns inflatable structures which are transformable from a collapsed condition for storage to an erect condition for use, and particularly, though not exclusively, for use as a play structure, such as a play house, tent or tunnel or similar for occupation by a child or adult, or by an animal, or such as a goal. However, the invention also concerns inflatable structures more generally.

BACKGROUND

Play structures, in particular, are often formed so that they can be transformed quickly from an erect condition for use, to a compact collapsed condition for storage. Many such structures include rigid support rods which must be assembled and dismantled, or are of the so-called pop-up kind and include cobble steel frame sections which when released from storage spring into an erect condition to support the structure, the steel sections being contained within sleeves to which are welded or stitched flexible webs of material forming the walls and roof of the structure.

An object of the present invention is to provide a structure which performs in a similar manner but which is transformed into its erect condition by inflation of one or more tubular sections forming a framework for the structure and to which are attached flexible webs to form, for example, walls and/or roof, and possibly also a base or groundsheet. Avoidance of the use of supports rods or steel frame sections results in the structure being lighter in weight and collapsible to a more compact form.

U.S. Pat. No. 4,068,418 discloses a tent transformable by inflation from a collapsed condition for storage to an erect condition for use, the tent comprising an inflatable tubular framework, which when inflated supports the structure in its erect condition, and a flexible wall structure attached to and extending between two or more regions of said inflatable framework. The inflatable tubular framework comprises a plurality of inflatable tubular elements, each of flexible, elastic, air-impermeable material and having a respective inflation valve, and each fitted inside a respective outer sheath of a material which is flexible but non-elastic. Each inflatable tubular element, when inflated, is a snug fit within its respective outer sheath and thereby restrained in outward expansion and prevented from rupturing. The inflatable tubular elements are formed by extrusion from thermoplastic material, such as PVC, and the outer sheaths are formed as separate curving sheaths which are separately cut to shape from woven material and stitched. Four such structural sections, each formed of an inflatable element inside its outer sheath provide four parabolic corner posts radiating out and down from a connector at a centre top location of the tent.

SUMMARY OF THE DISCLOSURE

The present invention provides a structure transformable by inflation from a collapsed condition for storage to an erect condition for use, the structure comprising an inflatable tubular framework, which when inflated supports the structure in its erect condition, and at least one flexible web attached to and extending between two or more regions of said inflatable framework. The inflatable tubular framework comprises an outer sleeve arrangement of a material which is flexible but substantially non-elastic and at least one inner inflatable tubular element of flexible, elastic, air-impermeable material and having an inflation valve. The or each inner tubular element is accommodated within the outer sleeve arrangement and is restrained therein upon inflation. Compared to the prior art, the present invention is characterised in that the outer sleeve arrangement is configured to include at least one bifurcation and/or bend and the inner tubular element is formed by cutting and bonding of the air-impermeable material to provide a continuous inflatable compartment having a configuration including at least one bifurcation and/or at least one bend, matching the configuration of the outer sleeve arrangement, the at least one inner tubular element being inserted to fit within the outer sleeve arrangement and substantially fill the outer sleeve arrangement upon inflation.

The inner tubular element, or each inner tubular element where there is more than one, is restrained within the outer sleeve arrangement upon inflation because the maximum diameter of the outer sleeve arrangement is less than the maximally inflated diameter of the or each inner tubular element so that expansion of the or each element upon inflation is restricted to the maximum diameter of the substantially non-elastic material of the outer sleeve.

Use of an inner tube constrained within an outer sleeve to provide the inflatable tubular framework of the structure allows a relatively high internal pressure to be created in the inner tube as it is inflated as far as possible. This results in a particularly firm framework of greater rigidity than can be achieved using tubular sections which have a unitary outer skin, or where there is no pressure limiting outer sleeve. Additionally or alternatively, the tubular sections of the framework structure in accordance with the invention may be of smaller diameter (thinner) than previously required for supporting fabric structures of equal size. This means they contain less air and can feasibly be inflated by simple hand or foot pumps rather than requiring electric pumps or continuous delivery of air, as is the case with some currently known inflatable structures.

Compared to the tent structure disclosed in U.S. Pat. No. 4,068,418, the present invention allows for a much wider range of structure shapes to be produced, not limited to having individual inflatable sections of defined curvature and not limited to use of inflatable tubes produced by extrusion. Production and assembly of structures in accordance with the invention is particularly cost effective.

A characteristic of the structure in accordance with the invention is that it includes at least one inflatable tubular element which is of a branching shape and/or which includes at least one bend. As used in this specification the term "bifurcated" refers to a forked or branched configuration and the term "bend" refers to an abrupt angular change in direction, as distinct from gradual curvature known in the prior art extruded inflatable sections.

Practical embodiments of the structure according to the invention, such as playhouse structures, typically include two inner inflatable tubular elements, each having a branching configuration which may also include at least one abrupt angular bend, and each providing a respective continuous inflatable compartment, inflated by a separate inflation valve. These two tubular elements provide a split inner framework. Together they match the overall configuration of the outer sleeve arrangement and they are fitted within respective parts of the outer sleeve arrangement, so as to have closed ends of each of the two elements confronting each other or other locations on the same or the other element. Thus, together these inner tubular elements, upon inflation, substantially fill the outer sleeve arrangement. Small gaps may remain at locations between confronting ends of the respective inflatable compartments or between a closed end confronting a different part of the same or the other tubular compartment. However, it is preferable that upon inflation these closed ends of the branching or bent configuration of each inflatable element touch against the part of the same or other compartment which they confront. Such contact enhances the structural stability of the inflated framework.

The concept of the invention can be applied more widely to many other structures and many structural shapes. Some embodiments within the scope of the invention may include only a single inner inflatable tubular element, thus a single inflatable compartment, of appropriate branching and/or bent configuration. Some embodiments may include one inner inflatable tubular element of branching and/or bent configuration and one or several other inner inflatable tubular elements which are merely individual straight or curving (that is to say not branching or abruptly bending) inflatable compartments. Yet other embodiments may include any number of branching or abruptly bending inner tubular elements, each a separate inflatable compartment, and any number of individual straight or curving inflatable elements/compartments. The complexity and cost of manufacture is the only limit and the design possibilities are endless. Thus, the concept of providing structures with inflatable frameworks in accordance with the present invention may be applied not only to various playhouses, tents, tunnels, shelters, goals, but also to decorative structures, such as for domestic use, for example to support storage pockets, or purely for decoration within bedrooms and other living areas, and also to items of furniture.

In order that the inflatable framework in accordance with the invention provides sufficient rigidity and stability to the structure it is important in respect of many embodiments that the outer sleeve arrangement is configured to include at least one continuous loop portion. Thus, where the flexible web extending between regions of the inflatable framework provides walls of the structure it is a feature of many embodiments that the outer sleeve arrangement is configured to surround at least one wall of the structure. Since the inner tubular element or elements fit within the outer sleeve arrangement to substantially fill it upon inflation, respective inflatable frame sections of the or each inner tube, constrained within the outer sleeve arrangement, also surround the wall to provide a substantially encircling frame or loop. However, these inner tubular elements do not provide a completely closed loop in the sense of a continuous loop inflated compartment. One, or more typically two, inner tubular elements are provided in characteristic branching or bending configuration, as already described, to substantially fill the outer sleeve arrangement, and the closed ends of the element or the respective tubular elements confront each other or confront other locations on the same or the other tubular element or elements. Accordingly, although a closed loop is provided in terms of structure, the internal inflated compartment this discontinuous because of the presence of the closed ends. In the typical case, mentioned above, where two inner tubular elements are provided, respective sections of each of the two tubular elements typically provide respective sides of the loop or frame such that the loop or frame is formed from parts of two separate inflatable compartments. However, in other embodiments, such a loop or frame, which surrounds a wall region, may be provided by sections of just a single inner tube, or by sections of more than two inner tubes.

As used in this specification the term "section" or "frame section" is defined as any straight or curving portion of any inner tubular element. An inner tubular element provides a continuous inflatable compartment. Thus an element which is bifurcated or bent at an angle will consist of several frame sections, each portion of the compartment between next closest bends or bifurcations being designated a frame section.

A typical wall of an inflatable structure in accordance with the invention is rectangular and may be supported by inflatable frame sections extending in the manner of an approximation to a closed loop or frame on all four sides, as just described. However, structures where walls have three sides maybe envisaged, and these may be supported by inflatable sections extending around all three sides in an approximation to a closed triangular loop shape. Yet other wall configurations may be envisaged where one or more sides of the wall are curved, but the same principle applies that a surrounding framework of inflatable sections (whether provided as parts of one, two or more inner tubes) is preferable. Such surrounding frames or loops of inflatable sections are desirable for more than one wall of any structure. For example, for a soccer goal structure the respective ends are preferably each surrounded by inflatable sections in a triangular loop shape. For more complex structures, such as playhouses of various forms, it is desirable that several walls are surrounded by inflatable sections to provide structural rigidity.

Provision of inflatable inner tubular elements as completely closed loops, i.e. continuously connected frame sections, is not feasible as this would necessitate, during production, the formation of the outer sleeve arrangement around the inflatable closed loop. This cannot be done with sufficient reliability either by stitching or by bonding. In particular, stitching risks puncture of the inner tube and bonding is insufficiently consistent, given the requirement reliably to restrain inflation of the inner tubular element, and also places constraint on the material of the outer structure, which needs to be cost-effective.

Therefore, the invention is most typically put into practice using an outer cover which is sewn together and includes the outer sleeve arrangement and webs extending there between to provide walls. The inflatable part of the framework is split into two or more parts, each being an inner tubular element of branching and/or angularly bent form, and the respective inflatable compartments provided by these tubular elements is fed through respective parts of the outer sleeve arrangement to substantially fill it, including by closed ends confronting each other or other regions of the same or other compartment within looped, wall-surrounding areas of the framework. The outer sleeve arrangement incorporates openings as access points at various positions to allow the feeding through of the respective inner tube elements.

In some structures in accordance with the invention an inflated horizontal portion of the framework, for example a portion over 5 feet (1.52 metres) in length as in the crossbar of a soccer goal structure, is required to remain substantially straight over an unsupported length. In order to counteract tendency for downward deflection, most prominent at the centre of such an unsupported length, the outer sleeve arrangement for that part of the structure can be cut and stitched to have an upwardly orientated camber.

DESCRIPTION OF THE DRAWINGS

Embodiments of the invention will now be described, by way of example only, with reference to the accompany drawings, in which.

Figure 7:
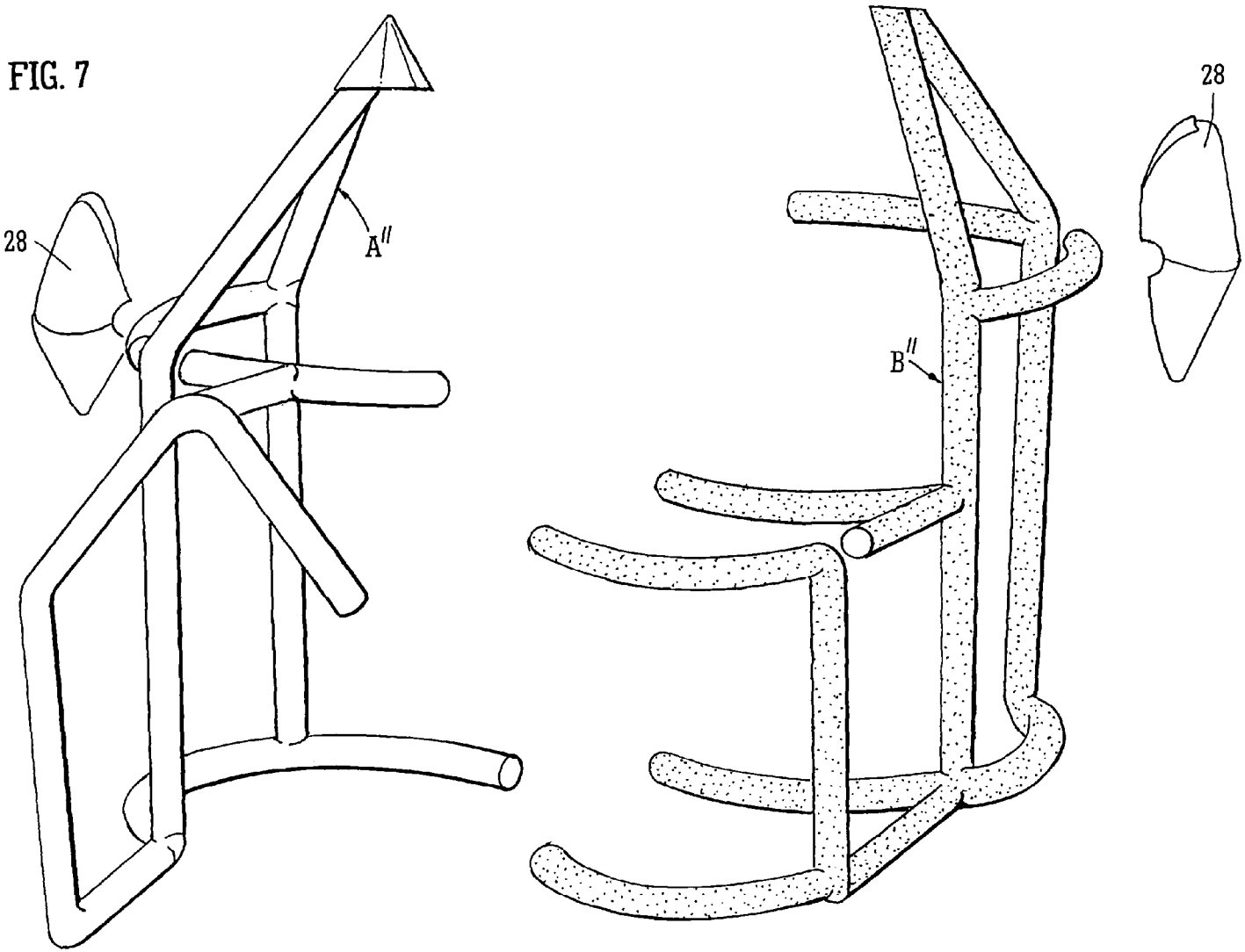
FIG. 7 is a perspective view of the two inflatable inner tubular elements of the play castle structure shown in FIG. 6, shown spaced apart.
Figure 8:
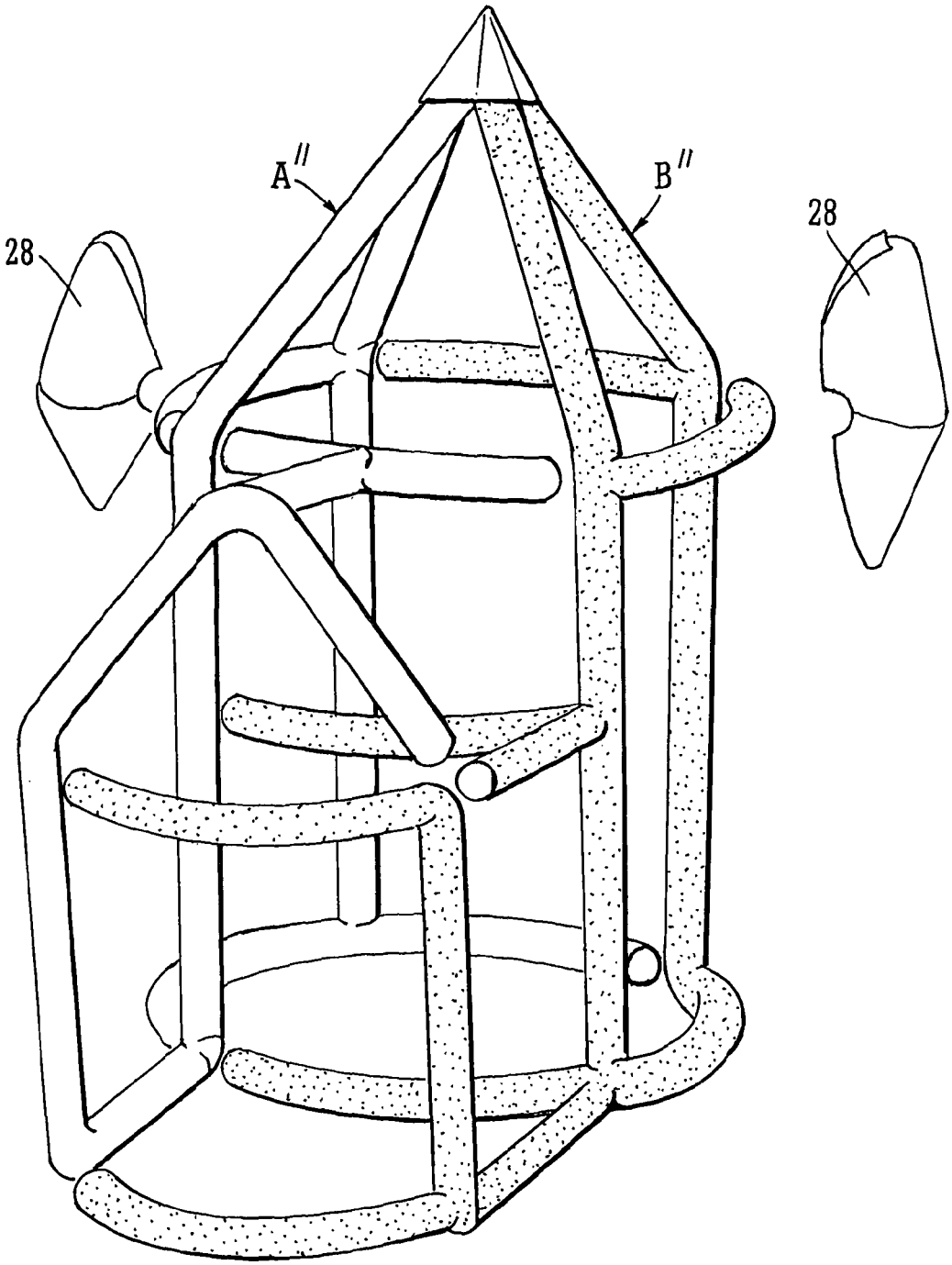
FIG. 8 is a perspective view of the inflatable inner tubular elements of figure positioned as in use in the play castle structure shown in FIG. 6.
Figure 9:
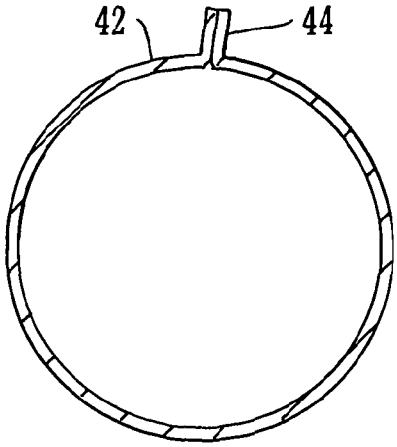
FIGS. 9 to 12 are schematic cross-sectional views illustrating how the inflatable tubular framework is provided by an inner inflatable tubular element constrained inside an outer sleeve in accordance with the invention.
Figure 10:
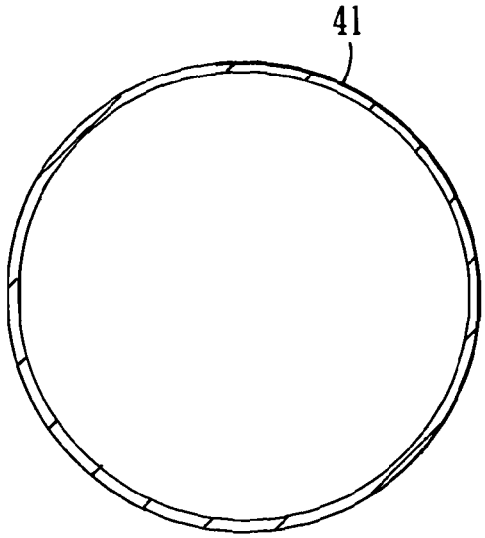
Figure 11:
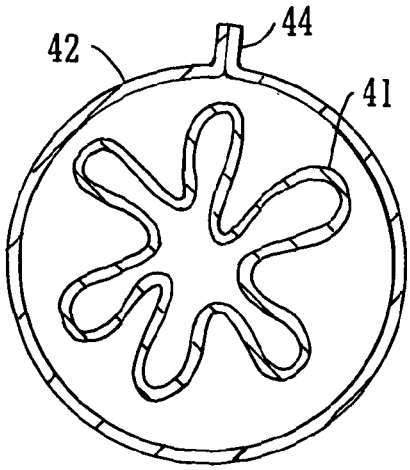
Figure 12:
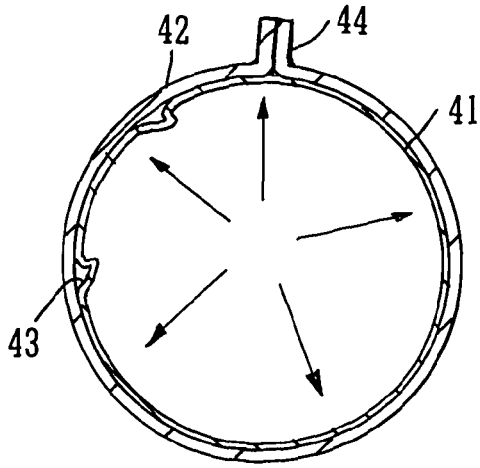

Referring firstly to FIGS. 9 to 12, these show diagrammatically the cross-sectional form of the inflatable tubular framework of structures in accordance with the invention, as exemplified in FIGS. 1 to 8. The or each tubular section comprises a separate inner tube 41 of flexible, impermeable, elastic material contained within an outer sleeve 42 of a material which is flexible but substantially inelastic. The inner tube 41 is not bonded to the outer sleeve 42, but merely contained inside it. The inner tube 41 is provided with an inflation valve (not shown in these figures) and is inflated to erect the structure. The maximum diameter of the outer sleeve 42, as shown in FIG. 9, is less than the maximally inflated diameter of the inner tube 41, shown in FIG. 10, so that upon inflation of the inner tube 41, as shown in FIGS. 11 and 12, the inner tube 41 is restricted to the maximum diameter of the outer sleeve 42. The inner tube 41 is shown schematically in its deflated condition in FIG. 11. In practice the material of the outer sleeve 42 would collapse inwards onto the deflated inner tube 41 in this condition. It is shown, again schematically, in its fully inflated condition in FIG. 12. In practice, the slight excess in the material of the inflated inner tube 41 may form slight wrinkles in the maximally inflated condition. This is indicated at 43, but in practice such wrinkles would be flattened.

The inner tube 41 is of thermoplastic material, and may suitably be formed of PVC. It is produced by cutting and welding from sheet material to the required shape of the inflatable framework of the relevant final structure being produced, or to respective parts of the said framework. The welded joints are not shown in FIG. 10. They may be lap joints bonding overlapping edge margins of the cut sheet material where it is folded to provide a tubular form with overlying edge margins, or they may be joints between confronting outwardly turned edge margins (similar configuration to the seam 44 of the outer sleeve) where the cut sheet material is folded to that form. The welding process is carried out with precision to ensure air-tightness of the or each tubular element. A preferred minimum thickness for PVC used as the inner tube material is 0.18 mm.

The outer sleeve 42 is of a woven or non-woven fabric. Suitable material is polyester or nylon. As illustrated in FIGS. 9 and 11, the outer sleeve 42 may also be produced by cutting and by stitched into tubular form and an out-turned seam 44 may be provided for attachment of a web of a supported structure. However, it is more typical for the outer sleeve arrangement of the inflatable framework to be produced by stitching additional fabric strips onto the material providing walls and/or roof sections of the structure, so as to provide tunnels for receiving the inner tubular elements, the material for the structure then typically being the same as that for the additional strips, namely polyester or nylon.

When the inner tube 41 is inflated it reaches the size where its inflation is restricted by the substantially fixed diameter of the outer sleeve 42. Introduction of further air causes the inner tube 41 to have increased internal pressure, thus creating a particularly firm and stable support framework for the structure. Compared to tubular sections of laminated form, tubular sections of such structure may be thinner yet provide same support strength, thus using less material and collapsing down in a deflated condition into a smaller package. Also, because the inner tube 41 has excess fabric compared to the outer sleeve 42 when said inner tube 41 is maximally inflated, the risk of punctures to the overall tubular section is reduced. Any sharp edge or object impinging upon the outer sleeve 42 will tend to cause the fabric of the inner tube 41 to move away, rather than offering resistance and potentially being punctured as might be the case if it was inflated to a tight condition.

The overall advantage of such a structure is that by avoiding the need for solid sections such as steel rods, fibreglass rods etc to provide rigidity for the framework, the completed product may be packed to a much smaller size and of considerably reduced weight thus reducing transportation and display costs. The overall reduction in mass and size of the structure when collapsed is of advantage when used for camping or travelling.

In manufacturing structures in accordance with the invention, such as those shown in FIGS. 1 to 8, the framework of the outer sleeves, corresponding to the outer sleeves 42 of FIGS. 9 to 12, is produced together with the fabric body of the structure providing walls and roofs etc, by cutting and stitching. The inflatable inner tubes, corresponding to the tubes 41 of FIGS. 9 to 12, are produced separately, by cutting and welding as previously explained, and then inserted into the outer sleeve arrangement, as a separate assembly step, to provide the inflatable framework. In this way the outer sleeves can be produced by stitching without risk of puncturing the inner tubes. Suitable openings, namely slits at intervals can be left in the outer sleeve framework to enable insertion of the inner tubes. The slits can subsequently be closed, for example by hook and barb fasteners, if required.

It is a feature of the present invention that the inflatable framework, consisting of the outer sleeve arrangement and the inner tube or tubes positioned therein is of branching configuration or includes abrupt bends in configuration, or both. This is most conveniently achieved by providing two inflatable inner tubes, thus two separate inflatable compartments. These two tubes, each itself being of branching configuration and/or incorporating abrupt bends in configuration, are then inserted into a branching outer sleeve arrangement so that ends of these branching inner tubes approach each other or approach other locations on the same or other tube. Together they substantially fill the outer sleeve. Essentially, however, there is a split in the inflatable inner framework. Upon inflation of the two tubes, via respective inflation valves for each, the ends of the tubes will typically contact the confronting ends or other locations, although a slight gap may sometimes remain.

Reference is now made to the three exemplary embodiments of FIGS. 1 to 3, FIGS. 4 and 5 and FIGS. 6 to 8, respectively, to show how these principles of construction are applied.

Figure 1:
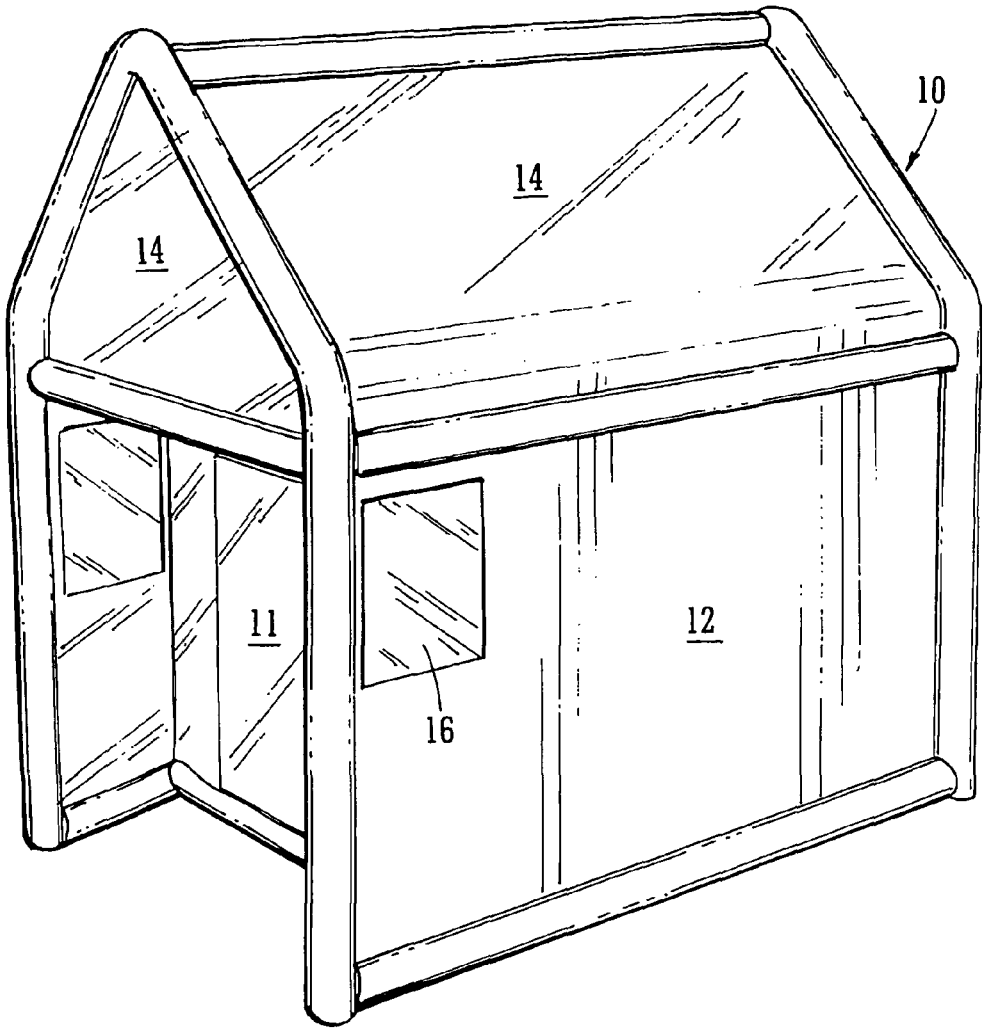
FIG. 1 is a perspective view of a first embodiment of a structure, in the form of a playhouse, made in accordance with the invention.
Figure 2:
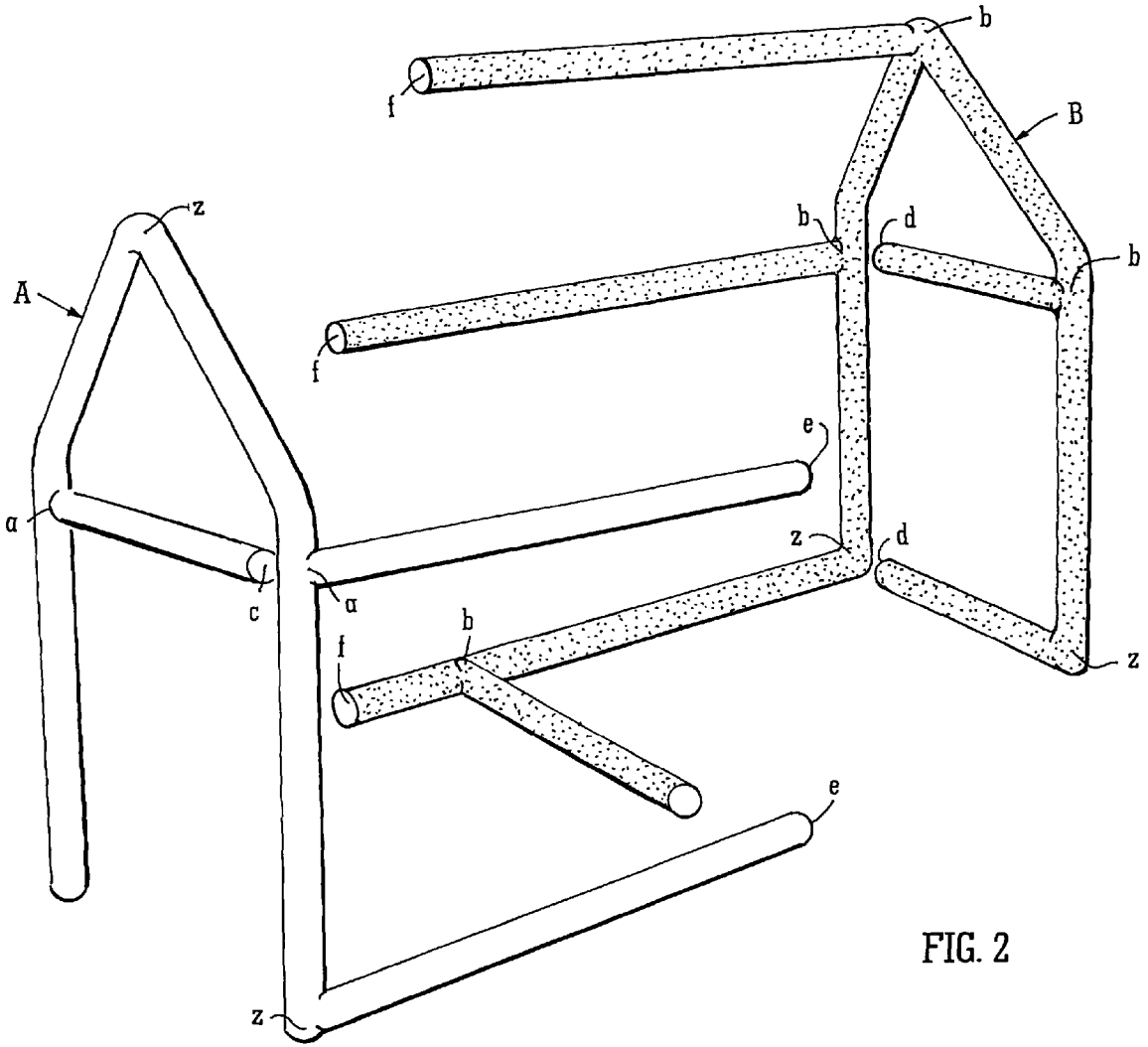
FIG. 2 is a perspective view of the two inflatable inner tubular elements of the playhouse structure shown in FIG. 1, shown spaced apart.
Figure 3:
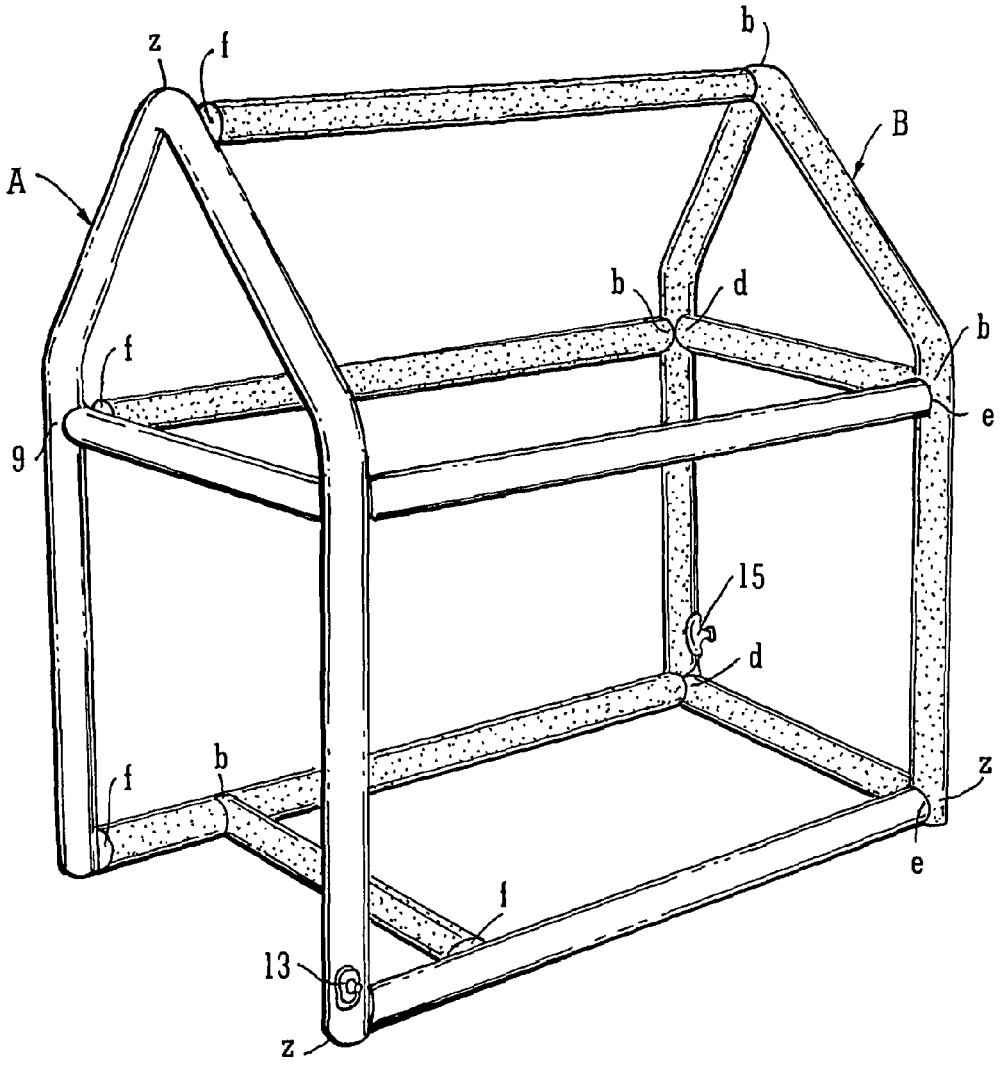
FIG. 3 is a perspective view of the inflatable inner tubular elements of FIG. 2 positioned as in use in the playhouse structure shown in FIG. 1.

The playhouse shown in FIGS. 1 to 3 has a fabric body comprising various wall sections 12 and roof sections 14, and also door 11 and windows 16, and this is supported by an inflatable tubular framework, designated generally at 10. The framework 10 consists of an arrangement of outer sleeves formed on the fabric body, on an inner surface of the body fabric, with two inflatable tubular elements disposed therein, as already described above. FIGS. 2 and 3 show the configuration and precise arrangement of these two inflatable inner tubes, designated A and B, each of which consists of a separate inflatable compartment with multiple branch points, designated a and b respectively, and with abrupt right angle bends designated z. Respective inflation valves for each tube A and B are shown at 13 and 15 of FIG. 3. Tube B is shown stippled for ease of illustration.

As already explained, in a deflated initial condition, during manufacture of the structure, the respective tubes A and B are inserted and fed through the outer sleeve/tunnel arrangement which has been formed on the fabric body. The pathways of the respective sections of the two tubes A and B are illustrated most clearly in FIG. 2 where these are shown spaced somewhat apart for illustration purposes only. The actual in use and inflated positions, namely the manner in which the respective inner tubes A and B are disposed within the outer sleeve arrangement as a split frame or discontinuous inflatable compartment is apparent by reference to FIG. 3.

Each inner tube A and B includes sections which surround, as a frame, all sides of a particular wall region of the fabric body, as at each end of the roof of the playhouse and at the end wall opposite to the door 11 (reference FIG. 1). This is by means of the branching structure of the inner tubes A and B having ends which confront locations on the same tube, typically by close approach thereto and by contact when fully inflated, as described above. Additionally, the inner tubes A and B cooperate to provide sections which together surround all sides of a particular wall region of the fabric body, such as those sections surrounding the front and rear walls of the playhouse and those sections surrounding the front and rear roof portions of the playhouse, and those sections surrounding a portion of the base of the playhouse. In these cases, each surrounding frame is rectangular and two sides of the surrounding frame may be provided by sections of tube A, two sides by tube B, or three sides may be provided by one of the tubes, and on site by the other, as in the case of the rear wall and the base region were three sides are surrounded by sections of tube B and only one side of the frame is contributed by a section of tube A.

More specifically:

Closed end c of the inner tube A confronts a location of same tube A.

Closed ends d of respective sections of the inner tube B confront locations of same tube B.

Closed ends e of inner tube A confront respective locations on the other tube B.

Closed ends f of inner tube B confront respective locations on the other tube A.

Figure 4:
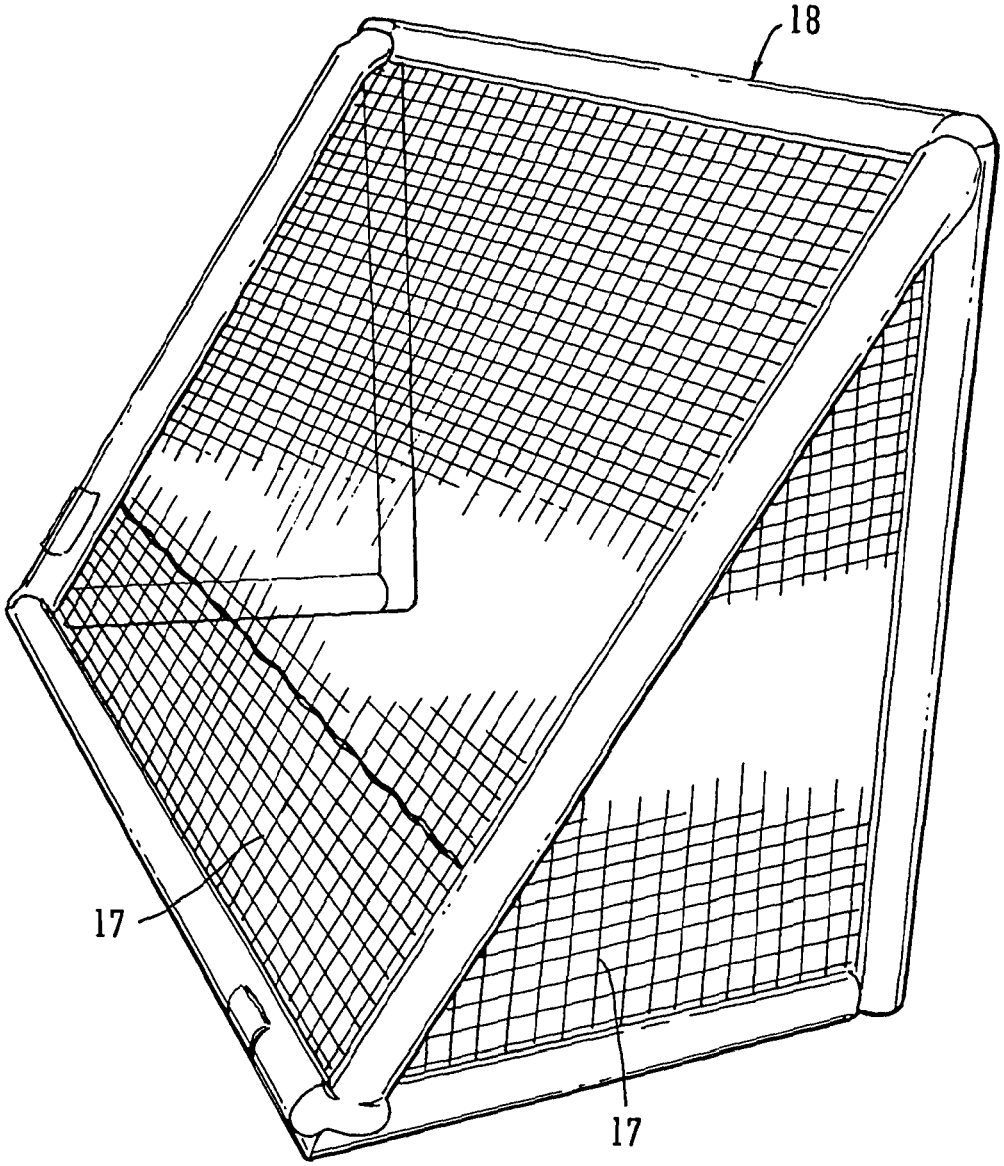
FIG. 4 is a perspective view of a second embodiment of a structure, in the form of a soccer goal, made in accordance with the invention.
Figure 5:
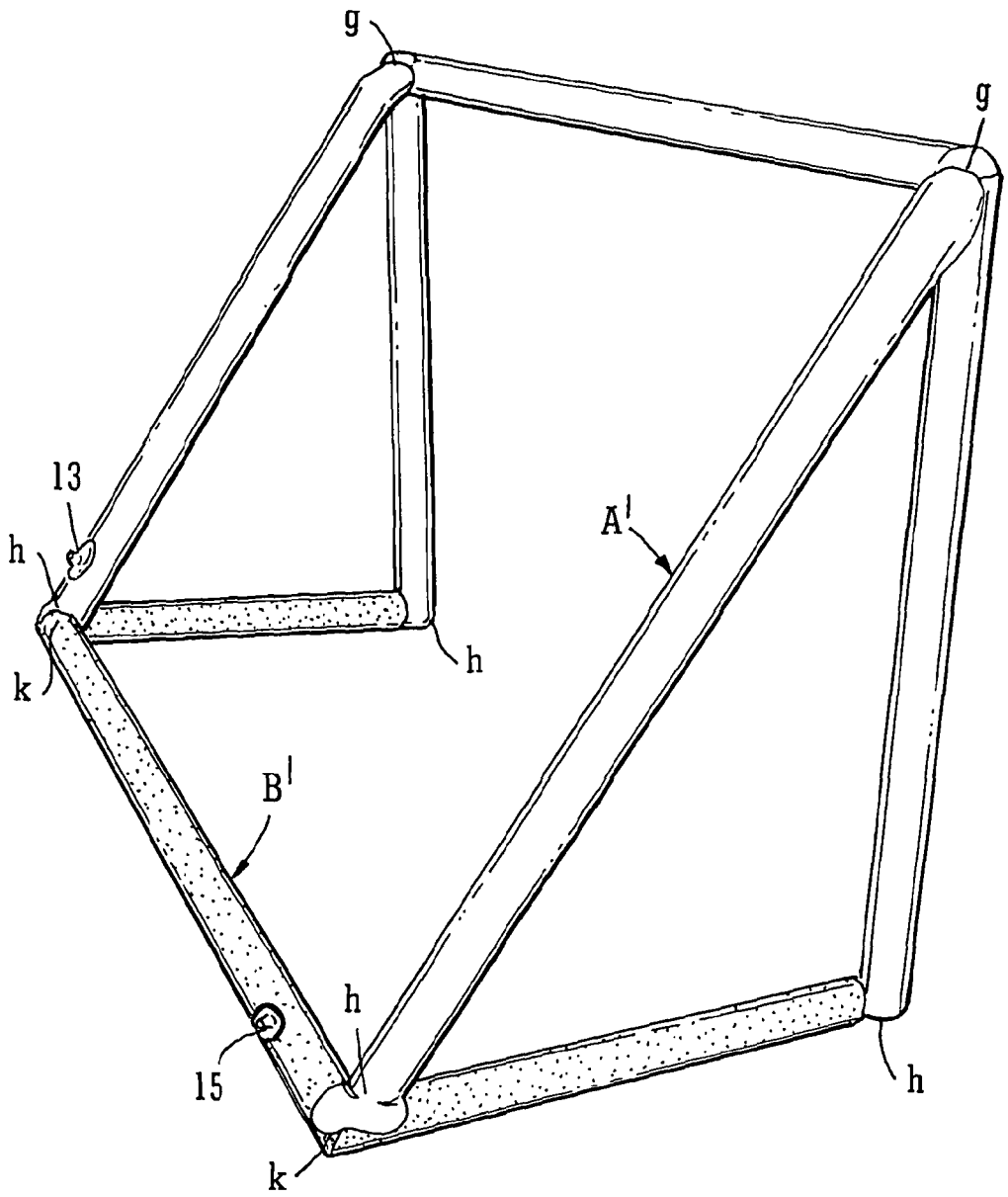
FIG. 5 is a perspective view of the two inflatable inner tubular elements of the goal structure shown in FIG. 3.

The goal shown in FIGS. 4 and 5 comprises mesh fabric sections 17 secured to an inflatable tubular framework, designated generally at 18. In this case, the tubular framework may firstly be produced as an outer sheath, similar to that shown in FIGS. 9, 11 and 12, and by cutting and stitching, to which the mesh fabric sections 17 are then secured by stitching or adhesion or by bonding in any other suitable manner. Two separate inflatable inner tubes A' and B' (FIG. 5) each consisting of a separate inflatable compartment, are then, during manufacture, inserted in deflated condition through appropriate openings which have been left in the outer sheath. In FIG. 5 they are shown as in position and when inflated in use. Again inner tube B' is stippled for ease of illustration and separate inflation valves 13, 15 for each of the inner tubes are shown. The tube A' branches at two locations g at each end of the crossbar, whereas the tube B' does not branch but is angled substantially at right angles at k at the rear corners of the goal enclosure. Closed ends h of the branch sections of the inner tube A' abut the ends of the inner tube B' and the rear bent locations k of the inner tube B' so that the respective triangular end walls of the goal structure are surrounded by inflated tube sections when the goal structure is in its fully inflated condition, as shown.

The tube A', in the section providing the crossbar, between branch locations g, is required to remain substantially horizontal when inflated in use. To achieve this over such an unsupported length, which may be over 5 feet (1.52 m), the initial outer sheath as cut and stitched is provided with an upward orientated camber to counteract the tendency for downward deflection, particularly at the centre, in the final inflated structure.

Figure 6:
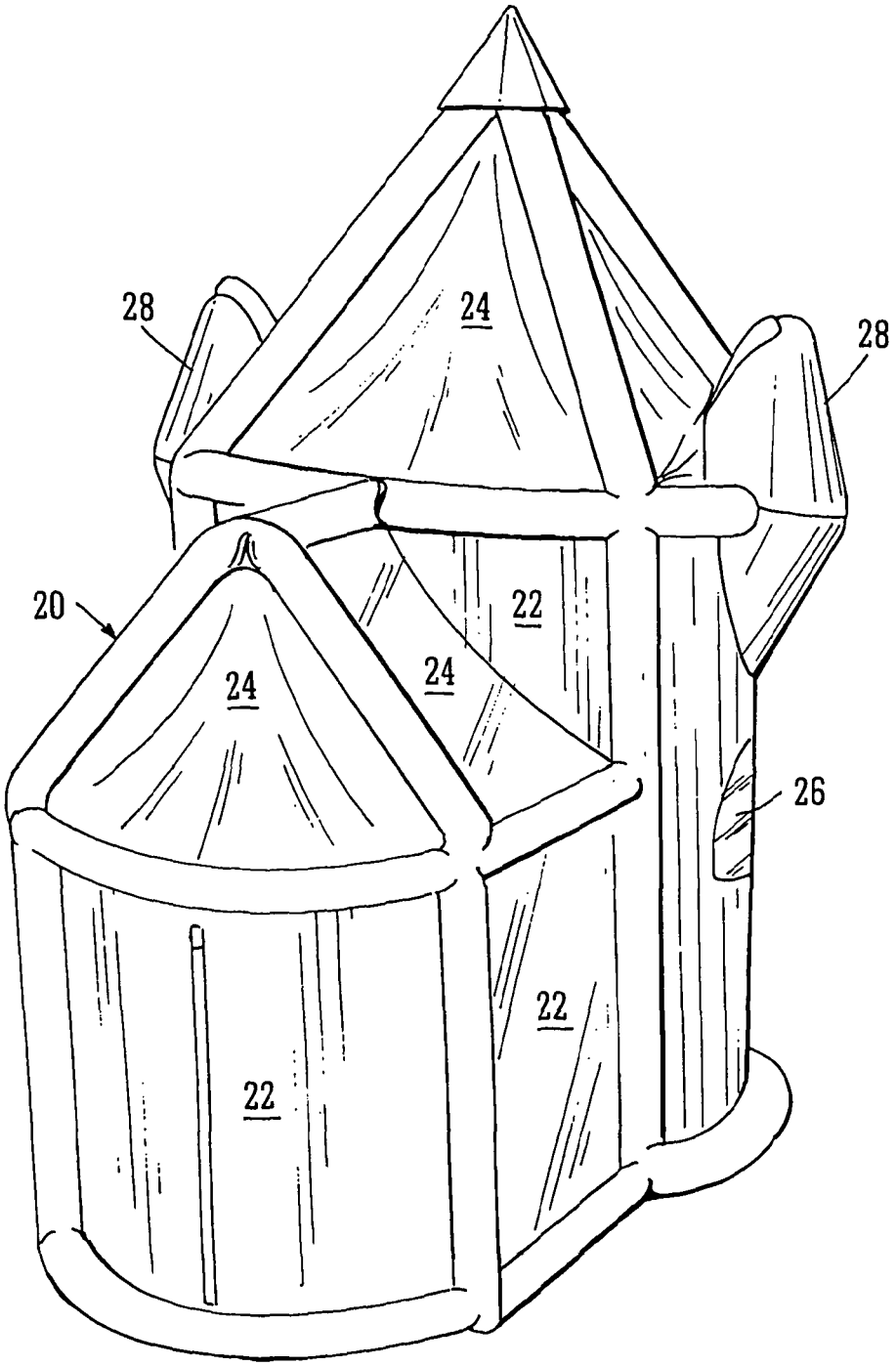
FIG. 6 is a perspective view of a third embodiment of a structure, in the form of a play castle, made in accordance with the invention.

The play castle shown in FIGS. 6 to 8 has a fabric body comprising various wall sections 22 and roof sections 24, and also a door and at least one window 26, and this is supported by an inflatable tubular framework, designated generally at 20. Just as with the earlier playhouse of FIGS. 1 to 3, the framework 20 consists of an arrangement of outer sleeves formed on the fabric body, on an inner surface of the body fabric, with two inflatable tubular elements A" and B", shown in FIGS. 7 and 8 disposed therein. In principle, these two inner tubes have all the features already described in relation to tubes A and B of the playhouse of FIGS. 1 to 3. However, the precise configurations of these two inflatable inner tubes A" and B" differ as shown, each having multiple branch points and abrupt right angle bends and being generally more complex than in the first embodiment. Some sections of the inner tubes are curved in this embodiment. Respective inflation valves are provided for each tube A" and B" but are not shown. Inner tube B" is again shown stippled for ease of illustration.

Separately inflatable structural parts 28 are shown which may be separately affixed to the structure.

In relation to each of these three illustrated embodiments, the framework 10, 18, 20, once inflated, becomes rigid and thus supports the structure in an upright and erect condition. However, when the framework is deflated the entire structure can be folded and reduced to a very compact form for storage, ideally within a drawstring bag or tote bag with handles or the like. Because of the overall configurations of the inflated tubes (A, B, A', B', A", B") in these structures, and their restraint within respective outer sleeve arrangements, to substantially fill the latter, relatively low air pressures, for example of the order of between 0.2 and 0.5 bar (2.9 to 7.25 psi) have been found sufficient to maintain these structures in erect condition for many days. Moreover, such low pressures minimise the amount of time and energy required for inflation and avoids requirement for electric pumps or other complex requirements.

It is emphasised that the foregoing embodiments are only examples of the very many different structural configurations which are possible within the scope of the present invention.

The invention claimed is:

1. A method of producing a structure transformable by inflation from a collapsed condition for storage to an erect condition for use, the structure comprising an inflatable tubular framework that, when inflated, supports the structure in an erect condition, and at least one flexible web attached to and extending between two or more regions of said inflatable framework, the method comprising:

fabricating an outer sleeve arrangement of flexible but substantially non-elastic material by cutting and stitching said material to a sleeve configuration that includes at least one bifurcation;

separately fabricating an inner inflatable tubular element of flexible, elastic, air-impermeable material by cutting and bonding the air-impermeable material to provide a continuous inflatable compartment having a configuration including at least one bifurcation, matching the configuration of the outer sleeve arrangement, and having an inflation valve; and inserting the inner tubular element into the outer sleeve arrangement and feeding it through the outer sleeve arrangement so that, upon inflation, the inner tubular element substantially fills the outer sleeve arrangement.

2. The method according to claim 1, wherein the inner tubular element has a maximum inflated diameter greater than the diameter of the outer sleeve arrangement.

3. A method of producing a structure transformable by inflation from a collapsed condition for storage to an erect condition for use, the structure comprising an inflatable tubular framework that, when inflated, supports the structure in an erect condition, and at least one flexible web attached to and extending between two or more regions of said inflatable framework, the method comprising:

fabricating an outer sleeve arrangement of flexible but substantially non-elastic material by cutting and stitching said material to a sleeve configuration that includes at least one bifurcation;

separately fabricating at least two inner inflatable tubular elements of flexible, elastic, air-impermeable material by cutting and bonding the air-impermeable material to provide two separate continuous inflatable compartments, each having a configuration including at least one bifurcation, matching the configuration the outer sleeve arrangement, and each having at least two closed ends and an inflation valve; and inserting the inner tubular elements into respective parts of the outer sleeve arrangement and feeding them through the outer sleeve arrangement so that, upon inflation, the at least two closed ends of one of the inner tubular elements confront locations on the same inner tubular element or the other inner tubular element thereby to substantially fill the outer sleeve arrangement.

4. The method according to claim 3 wherein the outer sleeve arrangement is fabricated to include closed loop framework regions and the inner tubular elements are inserted into the closed loop framework regions so that upon inflation the inner tubular elements similarly form a closed, but discontinuous, inflated region supporting a part of the structure.

5. The method according to claim 3, wherein at least one of the inner tubular elements has a maximum inflated diameter greater than the diameter of the outer sleeve arrangement,

* * * * *